US007383589B2

(12) United States Patent
Friedland et al.

(10) Patent No.: US 7,383,589 B2
(45) Date of Patent: Jun. 10, 2008

(54) SELF-STICKING BIBS AND METHOD OF MAKING

(75) Inventors: Frank Friedland, Boca Raton, FL (US); Michael B. Chasan, Boca Raton, FL (US)

(73) Assignee: NapKleen LLC, Boca Raton, FL (US)

( * ) Notice: Subject to any disclaimer, the term of this patent is extended or adjusted under 35 U.S.C. 154(b) by 0 days.

(21) Appl. No.: 11/757,625

(22) Filed: Jun. 4, 2007

(65) Prior Publication Data

US 2007/0220651 A1 Sep. 27, 2007

Related U.S. Application Data

(63) Continuation-in-part of application No. PCT/US2007/062638, filed on Feb. 23, 2007, and a continuation-in-part of application No. 11/561,965, filed on Nov. 21, 2006, and a continuation-in-part of application No. 11/362,321, filed on Feb. 24, 2006.

(51) Int. Cl.
*A41B 13/10* (2006.01)

(52) U.S. Cl. ..... 2/49.2; 2/49.4

(58) Field of Classification Search ..... 2/48, 2/49.1, 49.2, 49.4, 50, 51, 52, 49.3, 49.5; 156/247, 250, 253, 269, 199, 204, 209, 219, 156/290

See application file for complete search history.

(56) References Cited

U.S. PATENT DOCUMENTS 2,224,746 A 12/1940 Richstein
2,424,680 A 7/1947 Doyle
2,763,867 A * 9/1956 Chagnon ..... 2/49.1
2,803,574 A 8/1957 Payant
3,146,465 A * 9/1964 Hummel ..... 2/49.3
3,221,341 A * 12/1965 Hummel ..... 2/48
3,329,969 A * 7/1967 Roberts, Jr. et al. ..... 2/49.3
3,619,816 A * 11/1971 Cowen ..... 2/48

(Continued)

FOREIGN PATENT DOCUMENTS

GB 993838 6/1965

(Continued)

OTHER PUBLICATIONS

Web-site www.graphicice.com/index.php?action=prodspec &itemID=39419.

*Primary Examiner*—Amy B. Vanatta
(74) *Attorney, Agent, or Firm*—Martin Fleit; Paul D. Bianco; Fleit Gibbons Gutman Bongini & Bianco P.L.

(57) ABSTRACT

A bib has a front side and a rear side, a top and a bottom and opposite side edges. The bib is made from a layer of plastic and two layers of absorbent paper laminated and together. An adhesive is coated on the rear side of the bib adjacent its top and extending between the opposite side edges. A release tape covers the adhesive. A pocket extends between the opposite side edges formed at the bottom of the bib on its rear side having plastic on the inside of the pocket and paper on the outside of the pocket, so that when the pocket is turned inside out, it comes to the front side of the bib and maintains an opened condition. A method for making the bib.

17 Claims, 6 Drawing Sheets

U.S. PATENT DOCUMENTS

| | | | | | |
|---|---|---|---|---|---|
| 3,675,274 | A | | 7/1972 | Fried et al. | |
| 3,793,644 | A | | 2/1974 | Kellner | |
| 4,306,316 | A | * | 12/1981 | Klepfer | 2/48 |
| 4,423,523 | A | * | 1/1984 | Bodner et al. | 2/49.4 |
| 4,441,212 | A | | 4/1984 | Ahr et al. | |
| 4,601,065 | A | * | 7/1986 | Sigl et al. | 2/49.2 |
| 4,660,226 | A | * | 4/1987 | Quilling et al. | 2/49.2 |
| 4,779,288 | A | * | 10/1988 | Mack | 2/49.3 |
| D299,282 | S | | 1/1989 | Winans | |
| 4,977,626 | A | | 12/1990 | Smith | |
| 4,995,641 | A | | 2/1991 | Landry et al. | |
| 5,030,491 | A | | 7/1991 | Shoesmith | |
| 5,033,620 | A | | 7/1991 | De Luca | |
| 5,476,697 | A | | 12/1995 | Bellander | |
| 5,552,200 | A | | 9/1996 | Gureff | |
| 5,640,716 | A | | 6/1997 | Oldham | |
| 5,672,056 | A | * | 9/1997 | Fisher et al. | 433/137 |
| 5,799,336 | A | | 9/1998 | Cooper | |
| 5,875,490 | A | | 3/1999 | Woodard et al. | |
| 6,000,056 | A | | 12/1999 | Brady et al. | |
| 6,021,550 | A | | 2/2000 | Welch | |
| 6,079,048 | A | | 6/2000 | Campbell | |
| 6,212,683 | B1 | * | 4/2001 | Liebmann | 2/49.4 |
| 6,219,846 | B1 | | 4/2001 | Toole | |
| 6,256,788 | B1 | * | 7/2001 | Loewer et al. | 2/49.2 |
| 6,342,297 | B1 | | 1/2002 | LaBrash | |
| 6,493,879 | B1 | * | 12/2002 | Hibler | 2/49.1 |
| 6,548,135 | B1 | | 4/2003 | Hershey et al. | |
| 6,884,494 | B1 | * | 4/2005 | Curro et al. | 428/196 |
| 2002/0029400 | A1 | | 3/2002 | Smith | |
| 2004/0224116 | A1 | | 11/2004 | Manasa | |
| 2005/0144693 | A1 | | 7/2005 | Hagen | |
| 2005/0269217 | A1 | | 12/2005 | Farmer | |
| 2007/0006357 | A1 | | 1/2007 | Hall | |
| 2007/0061938 | A1 | | 3/2007 | Reimer | |
| 2007/0143904 | A1 | * | 6/2007 | Brown | 2/49.1 |
| 2007/0199123 | A1 | | 8/2007 | Friedland et al. | |
| 2007/0220651 | A1 | | 9/2007 | Friedland et al. | |

FOREIGN PATENT DOCUMENTS

| | | |
|---|---|---|
| GB | 1095397 | 12/1967 |
| WO | WO 87/06105 | 10/1987 |

* cited by examiner

SELF-STICKING BIBS AND METHOD OF MAKING

RELATED CASE

This application is a continuation-in-part of application Ser. No. 11/362,321 filed Feb. 24, 2006, application Ser. No. 11/561,965 filed Nov. 21, 2006, and International Application PCT/US2007/062638, filed Feb. 23, 2007 the contents of which are herein incorporated in their entirety, and for which a claim is made under 35 USC Sec. 120.

BACKGROUND OF THE INVENTION

1. Field of the Invention

The present invention relates to an improved self-sticking bib self-sticking bib for protecting a wearer while eating or any other activity that could adversely affect the clothes of a wearer, and a method of making same.

2. Prior Art

One common definition of a bib is a small piece of material fastened under a chin to protect the clothing while eating. As a result, bibs have a connotation that typically associates their use with infants and toddlers. In fact, adults are generally much less apt to spill or splatter food onto their clothing compared to children. Nevertheless, there are certain situations in which it is appropriate or desirable for an adult to don a bib. Such a bib may either be a conventional bib or simply a tucked or otherwise secured napkin covering the chest.

Conventional bibs typically have two strings which tie around the neck to hold the bib in place. Other bibs use snaps, ties, strings, hook and loop fasteners, or the like to attach around the neck. More recently, some bibs have eliminated the strings and ties altogether and have instead used adhesive strips. These strips are located near the shoulder area on the backside of the bib and are used to adhere the bib to the wearer. Thus, bibs provided with an adhesive so they can adhere to a wearer are known from the art. However, such known bibs have various drawbacks, particularly regarding how they are constructed and how they are made.

Although a wide variety of bib designs can be adequate to protect one's clothing, a bib, regardless of design, has no ability to clean and/or sanitize either a food contacting surface or any portion of the wearer's body. For such cleaning and/or sanitizing, one must separately utilize either an agent (e.g. antibacterial lotion) or item (cleansing wipe). In some situations, it would be beneficial if the agent or item formed a part of or was packaged with the bib.

Bibs provided with an adhesive so they can adhere to a wearer are known from the art. However, such known bibs have various drawbacks, particularly regarding their construction and how they are made. A principal drawback lies with bibs that use a pocket at the bottom of the outfacing side to catch drippings. Pockets made for this purpose tend to lie flat and do not stay open, and therefore, do not successfully catch drippings. The principal object of the present invention is to provide a novel improved self-sticking bib that includes a pocket that solves this irksome problem, and a method of making same.

SUMMARY OF THE INVENTION

Accordingly, the objects of the invention are achieved by providing an improved self-sticking bib with a pocket that stays open for protecting a wearer while eating or any other activity that could adversely affect the clothes of a wearer. The bib is particularly useful with young children and infants during feeding. The foregoing is accomplished by the present invention by providing a construction consisting of laminated layers of paper and plastic, with two layer of tissue paper on the front side of the bib facing out and a plastic layer on the rear side facing in toward the wearer. The plastic side has a stripe of adhesive adjacent its top edge running completely across the bib from side edge to side edge. The adhesive stripe is covered with a release strip. In use, the release strip is removed to expose the plastic stripe, which serves as a means to stick on the wearer. A pocket from about 1 to 4 inches in depth is formed at the bottom of the rear side facing in so that it has plastic on the inside of the pocket and paper on the outside. In use, the pocket is folded inside out, which brings it to the front side facing out at its bottom. This now constitute a pocket on the front side of the bib that has plastic on the outside of the pocket and paper on the inside of the pocket. Most important, the folding inside out of the pocket results in the pocket staying in an opened condition. Now the paper-lined pocket lies at the bottom of the paper front side facing out, is open and can readily catch food, etc. that falls from the mouth of the wearer, or is spilled on the way to the mouth of the wearer.

An alternative structure of the inventive bib for providing an improved self-sticking bib with a pocket that stays open for protecting a wearer while eating or any other activity that could adversely affect the clothes or body of a wearer, comprises a sandwich lamination of a plastic layer intermediate two tissue paper layers, one on each side of the plastic layer. One of the paper layers of the lamination serves as the front outwardly facing side of the bib, and is coextensive with the plastic layer from top to bottom of the bib blank, whereas the other paper layer serves as the back inwardly facing side of the bib and is shorter than the plastic layer from top toward the bottom. The other paper layer terminates by about 2 to 8 inches, and preferably 4 inches from the bottom of the bib blank. This difference enables a pocket to be formed on the back inwardly facing side of the bib having plastic inside and paper outside, in the manner described above. Therefor, it now becomes possible to turn this pocket inside out to form the permanently opened pocket on the front side of the bib with plastic on the outside and paper on the inside of the pocket. In addition, the bib now has paper on both the front and rear sides, so after serving its purpose as a bib, it can then be used as a napkin either in place or after removal from the wearer.

The method for making the novel bib comprises laminating a layer of plastic, most preferably, a polyethylene film with at least two absorbent tissue paper layers, most preferably, a cellular tissue paper, which can include a previously printed decoration or motif. The resulting lamination or bib blank occurs by an embossing technique, carried out so that an array of spaced depressions is made in the tissue layers while heating the polyethylene layer to cause impregnation of the tissue layers. The array of embossed tissue depression portions of the tissue layers are pressed into the heated plastic layer, and the layers adhere together. The portions of the tissue layers surrounding the pressed tissue portions, i.e. the unpressed portions, are left substantially unaffected, and therefore, they retain their original characteristics for absorption of liquids and other foods. The lamination is next followed by a step of applying, preferably by continuously spraying, a biocompatible adhesive or glue across the top edge, or adjacent the top edge, of the exposed polyethylene layer on the rear side of the bib blank from one side edge to the opposite side edge, i.e. in a transverse direction relative to top to bottom of the bib. If the bibs are being made using traveling webs, then, in the direction of travel of the web. The adhesive chosen is one that will adhere to clothes or human skin and yet be easily removed with slight pulling with no adverse effects to the clothes or the skin. Such adhesives are well known in the art. Next, the adhesive stripe applied to the web is covered with a removable sealing tape or release paper, a strip of suitable material so that the adhesive is not exposed and is fully covered and yet the covering release paper is easily removable. Such materials are well known for several applications, such as, self-sealing envelops or Telfa™ bandages. Finally, the laminated structure is folded from the bottom to form a pocket on the back side of the bib blank with the plastic side edges of the pocket now brought together face to face and they are heat sealed. If the laminated structure is a moving laminated web, then it is cut transversely at space intervals and the resulting cut pieces (now bibs) are stacked. The webs are 18 inches wide and cut at 13 inch intervals to produce bib blanks that are 13 inches wide and 18 inches long with the adhesive at the top edge of the inside rear face or side of the bib composed of a double layer of tissue laminated to single plastic layer, preferably polyethylene. Thus the adhesive is on the polyethylene side, the rear side of the bib. The pocket is formed on the inside rear face or side of the bib blank, also, on the polyethylene film side.

In another embodiment, the laminating a layer of plastic is a biodegradable plastic film. Exemplary biodegradable plastics include thermoplastic starch biodegradable plastic (TPS), starch synthetic Aliphatic Polyester Blend, Starch and polybutylene succinate (PBS) or polybutylene succinate adipate (PBSA) polyester blends, polylactic acid, etc.

As an alternative to the above, a novel bib is made by laminating a layer of plastic, most preferably, a polyethylene in between at least two absorbent tissue paper layers, most preferably, a cellular tissue paper (sandwich construction). Thus one paper layer will lie on the front side of the bib and the other paper layer will lie on the rear side of the bib. The layer on the front side of the bib can include a previously printed decoration or motif. A stripe of adhesive is placed (sprayed) on the rear side of the bib at the top edge and covered with a release paper strip. The paper layer on the rear side of the bib extends from the top edge of the bib blank, but terminates spaced from the bottom edge of the bib blank by 2 to 8 inches. Therefore, the bottom portion of the bib blank has plastic exposed. The bottom portion of the bib blank is folded up to form a pocket 1 to 3 inches in depth on the rear side or face of the bib. Therefore, the exposed plastic layer is folded on itself and the side edges of the pocket are heat sealed together. The pocket formed has plastic, polyethylene, on the inside and paper on the outside with the edges of the folded up portion of the bib heat sealed along each of the folded up side edges to form a pocket in the bottom of the bib on the rear side that will be against the wearer. In use, the pocket is folded inside out, and comes to the front of the bib with the plastic now on the outside and paper on the inside. But more important, the pocket now is in a permanently open condition and will catch any food that falls down on or adjacent to the bib while being worn by a user. With paper now on the inside of the pocket, there will be better absorption of food drippings.

In another embodiment, the laminating a layer of plastic is a biodegradable plastic film. Exemplary biodegradable plastics include thermoplastic starch biodegradable plastic (TPS), starch synthetic Aliphatic Polyester Blend, Starch and polybutylene succinate (PBS) or polybutylene succinate adipate (PBSA) polyester blends, polylactic acid, etc.

The folded up portion can be from 1 to 4 inches deep to form a suitable pocket to catch the spills or droppings. If traveling webs are being used, the folding up of the lower portions of the bibs can take place before the bibs are cut at transversely spaced intervals with the cutting and the heat sealing of the folded up edges occurring simultaneously. However, it is preferred that the heat sealing of the edges of the pockets takes place either before or after the cutting into individual bibs.

A further improvement consists of using webs that are a multiple of the length of the bib to be made, i.e. 2×, 3×, . . . n×, and the adhesive sprayed onto or adjacent one edge of the polyethylene web as it travels or moves longitudinally. Thereafter, the adhesive stripes can be covered with a release tape; the webs, if more than 18 inches wide are cut longitudinally at 18 inch intervals and then are cut at predetermined transverse intervals, such as 13 inches to create sections that are bib wide. Thereafter, the cut web sections are finished by folding to form pockets as described in the foregoing, heat sealed to perfect the pockets and folded and/or stacked.

It is a further object of the invention to provide a bib having a front side and a rear side, a top and a bottom and opposite side edges composed of a layer of plastic and two layers of absorbent paper laminated and together, an adhesive coated on the rear side of the bib adjacent its top and extending between the opposite side edges, a release tape covering the adhesive, and a pocket extending between the opposite side edges formed at the bottom of the bib on its rear side having plastic on the inside of the pocket and paper on the outside of the pocket, so that when the pocket is turned inside out, it comes to the front side of the bib and maintains an opened condition. The pocket of the bib may be 1 to 4 inches deep.

The bib according to the above wherein the two layers of absorbent paper may lie on one side of the plastic layer. Alternatively, the two layers of absorbent paper may lie on opposite sides of the plastic layer.

The bib according to the above wherein the two layers of absorbent paper may be embossed together. Also, the two layers of absorbent paper may have an array of spaced depressions heat sealed to the plastic film. Further, the depressions may be rectangular.

Where the plastic layer is between the paper layers, the paper layer lying on the rear side of the bib is terminated spaced from the bottom of the bib to accommodate the pocket.

It is still a further object of the invention of providing a method of making a bib comprising the steps of:

laminating a plastic layer of preselected geometry with two layer of absorbent paper with similar preselected geometry to form a laminated construction having a front side and a rear side, a top and a bottom and opposite side edges;

applying a stripe of an adhesive adjacent the top of the rear side of the lamination;

covering the stripe of adhesive with a release tape; and forming a pocket on the rear side of the lamination at the bottom having plastic on the inside of the pocket and paper on the outside of the pocket, so that when the pocket is turned inside out, it comes to the front side of the lamination and maintains an opened condition.

In the method described above, the absorbent paper may be a tissue paper. In the method described above, the plastic layer may be polyethylene. Alternative, the plastic layer may be a biodegradable film. Further, the paper layers may be embossed to form an array of spaced areas of a predetermined configuration. The preselected geometry of the bib may be rectangular.

Still further, in the method described above, the plastic layer and paper layers may be initially in the form of webs that are laminated together. Also, the laminated web may be a predetermined dimension wide. Still further, the laminated web may have a width that is a multiple of a predetermined bib length. The method may include the further steps of cutting the laminated web into longitudinal sections each of a width equal to bib blank length, and applying the stripe of adhesive adjacent one edge of each section.

The method may also include the further steps of folding the edge of the laminated web, opposite the edge to which the adhesive is applied, and heat sealing the edges of the folded laminated web to form pockets on the same side of the web as the adhesive. Alternatively, if bib blanks are individuated from the laminated web, pockets are formed by folding up the edge of the bib blank opposite the edge adjacent to which adhesive has been applied, and heat sealing the folded up side edges of the bib blanks.

In the method as described above, the absorbent paper used may be 19 gram tissue paper and the plastic may be polyethylene. Alternatively, the plastic layer may be a biodegradable film. Also, the paper layer that ends up on the front side of the bib may be imprinted with a design or motif.

Other and further objects and advantages of the present invention will become more apparent form the following detailed descriptions of preferred embodiments of the invention when taken with the appended drawings.

DETAILED DESCRIPTION OF PREFERRED EMBODIMENTS OF THE INVENTION

Figure 2:
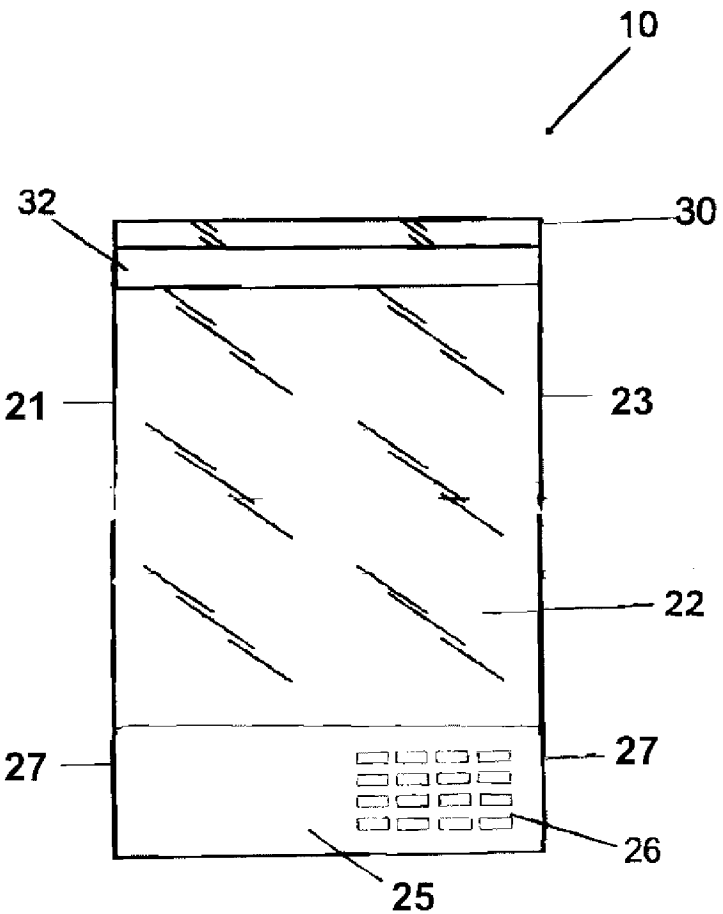
FIG. 2 shows the back side of the bib shown in FIG. 1.

Referring now to the drawings, preferred embodiments will now be described. In FIGS. 1, 2, 4 and 7 a bib 10 is shown front and rear consisting of a rectangular configuration composed of two overlying sheets (layers) of 19 gram cellular tissue 20*a* and 20*b* on the front side and polyethylene (plastic layer) 22 on the rear side. The tissue 20 can be imprinted with any suitable pattern or motif 24 and has been embossed with small rectangular depressions 26 that have been heat sealed to the polyethylene sheet 22. On the rear side of the bib, see FIG. 2, the polyethylene sheet 22 has an adhesive 28 stripe coated along or adjacent to its top edge 30 extending from one side edge 21 to the other side edge 23, and is covered with a release tape in the form of a removable cover strip 32, e.g. glassine paper. To use the bib, the cover strip 32 is removed and the bib 10 attached or stuck to the user by the adhesive 28. The cellular tissue sheet 20*a* is facing outwardly to catch and absorb any food or liquid that may spill. Formed at the bottom of the bib is a pocket 25. The pocket 25 is formed by folding up the bib from the bottom on itself at the rear side as shown in FIG. 2, so that the polyethylene 22 overlies itself. The side edges 21 and 23, at the bottom are heat sealed at 27 to form the pocket 25.

Figure 4:
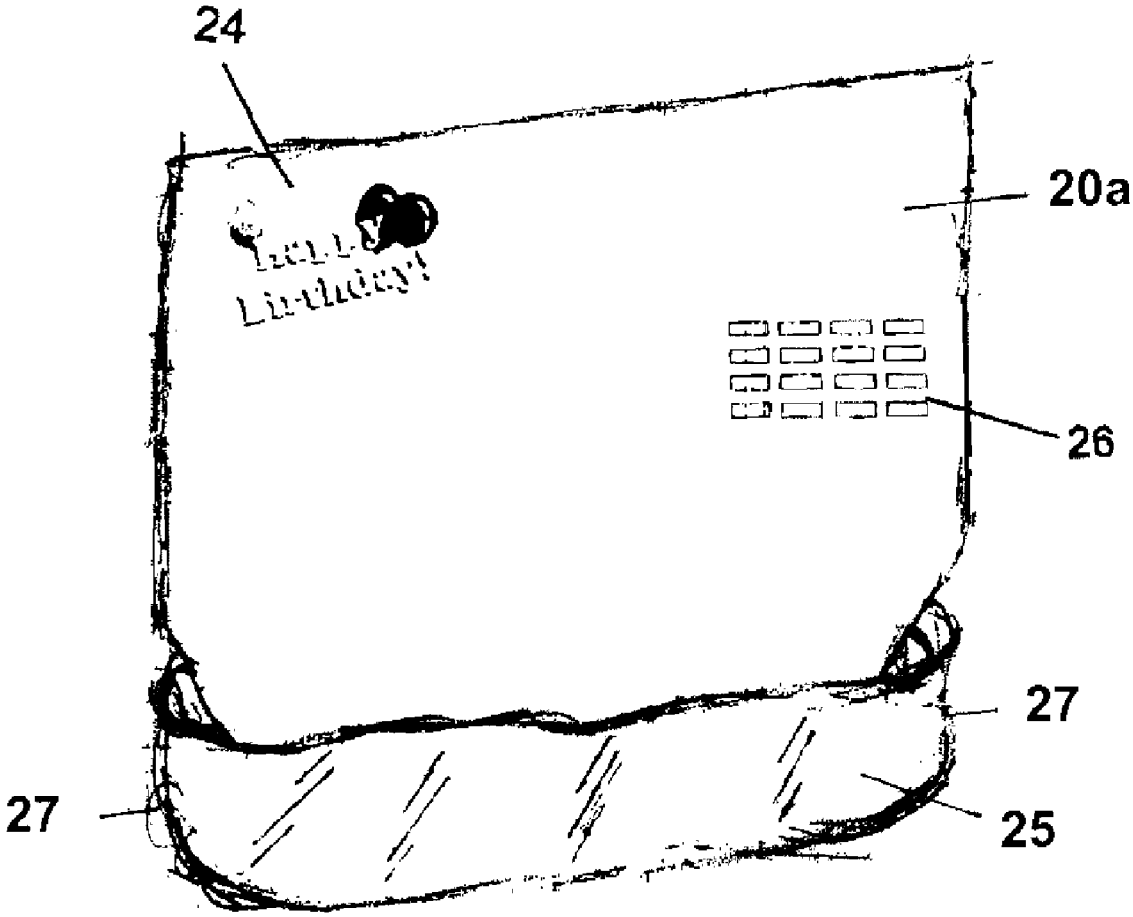
FIG. 4 shows the pocket of the bib shown in FIG. 1 folded inside out.

In use of the bib, the pocket 25 is turned inside out, which has the effect of bringing the pocket to the front side or face of the bib, and also causing the pocket to stay permanently opened as shown in FIG. 4. Now, the pocket has plastic on the outside and paper on the inside. Thus, the effectiveness of the pocket is greatly improved and enhanced.

Figure 1:
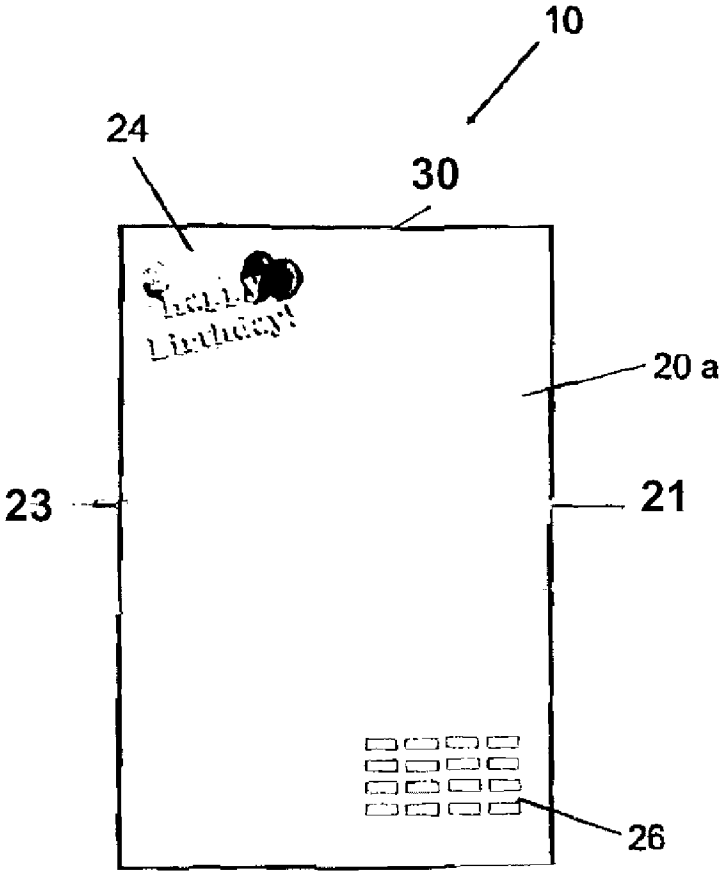
FIG. 1 shows the front side of a bib made according to the present invention.
Figure 3:
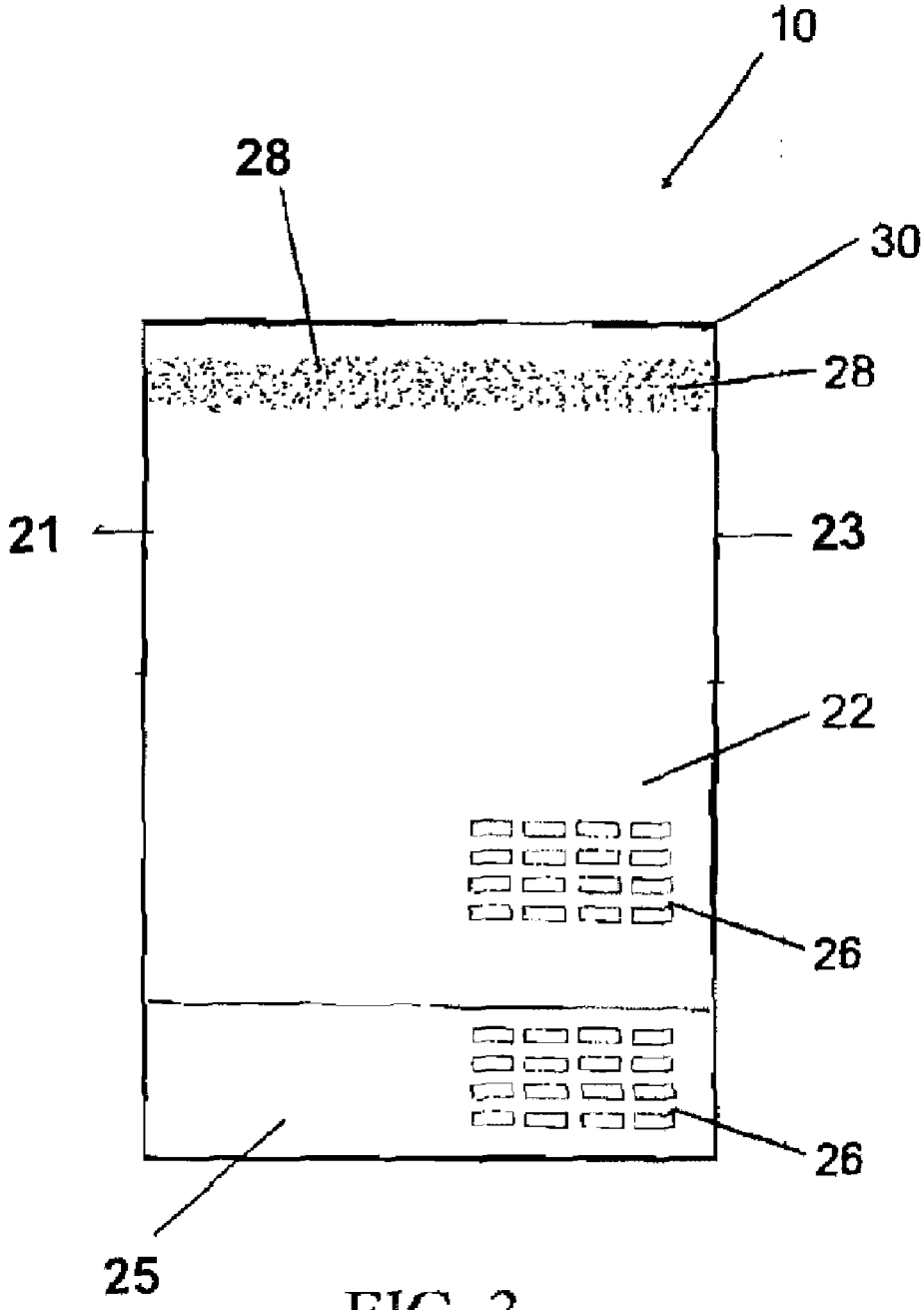
FIG. 3 shows the front side of a variation of the bib shown in FIG. 1.
Figure 6:
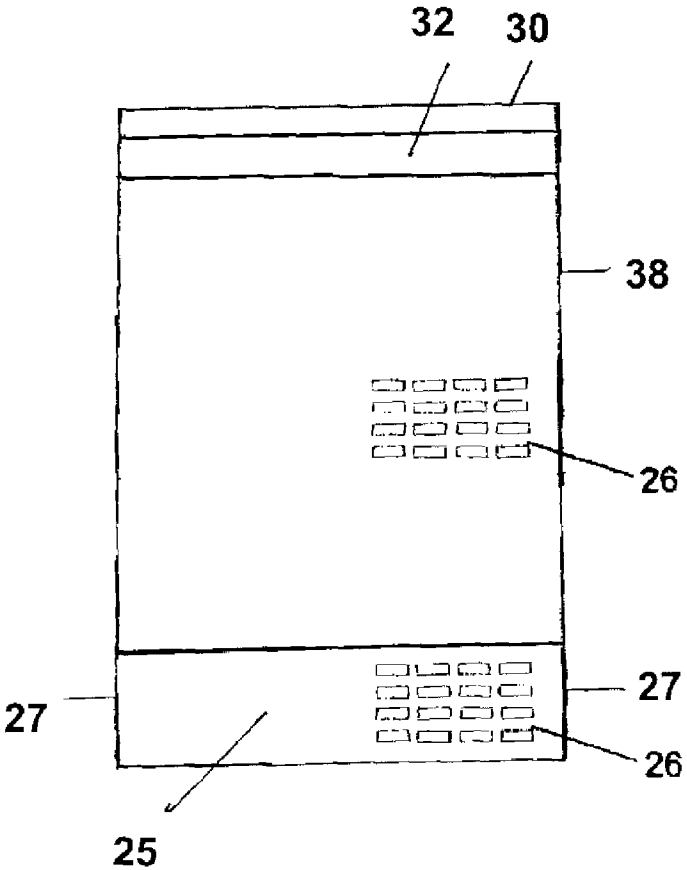
FIG. 6 shows the back side of the bib shown in FIG. 5 after the pocket has been formed.
Figure 5:
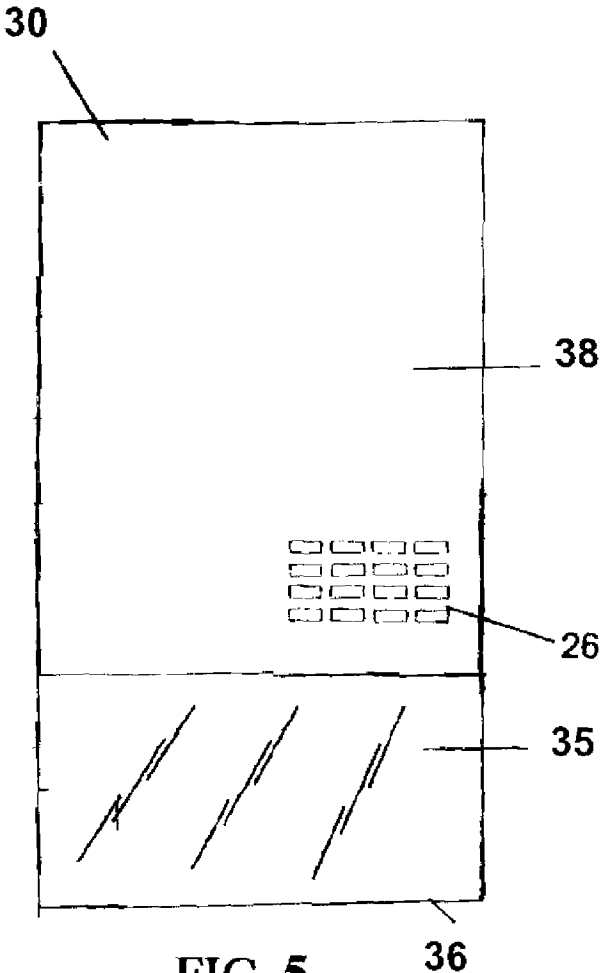
FIG. 5 shows the back side of a bib blank for forming the bib of FIG. 3 before the pocket has been formed.
Figure 7:
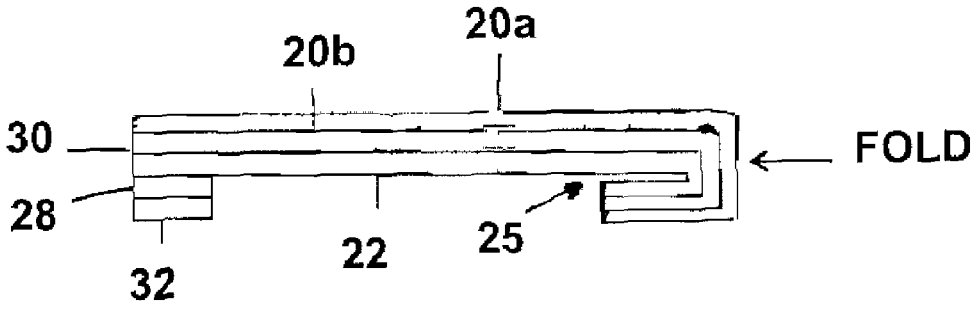
FIG. 7 shows in section the bib shown in FIG. 1.
Figure 8:
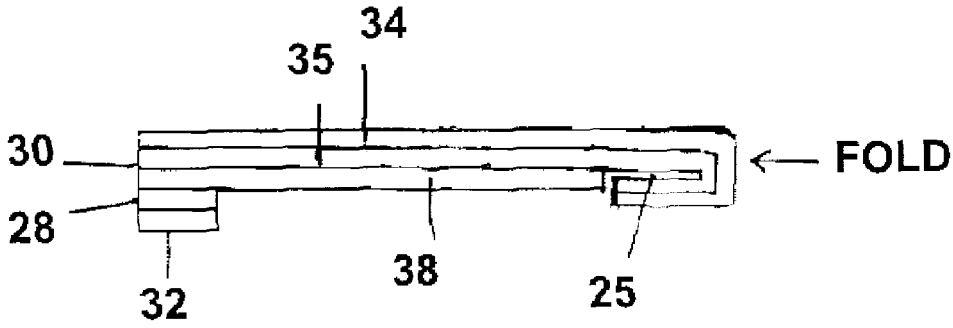
FIG. 8 shows in section the bib shown in FIG. 3.

An alternative variation is shown in FIGS. 3, 5, 6 and 8. The embossed lamination or bib 10 now consists of a sandwich of paper-plastic-paper. The rear side of the bib is shown in FIG. 3 with the release covering 32 removed, revealing adhesive 28 extending from side 21 to side 23. The front face paper layer 34 extends from top edge 30 to bottom edge 36 of the bib blank, as shown in FIG. 5. On the other hand, the rear paper layer 38 terminates short of the bottom from 2 to 8 inches, and that leaves the intermediate plastic layer 35 exposed. When the bottom of the bib blank is folded up with the plastic layer 35 folded on itself, and the edges 21 and 23 at the bottom heat sealed 27, a pocket 25 will be formed, as shown in FIG. 6 with plastic inside and paper outside. When the pocket is turned inside out, the bib will look like that shown in FIG. 4, with paper on the inside and plastic on the outside of the pocket 25. The only difference between the bibs of FIG. 1 and FIG. 3 is that in FIG. 1, the rear face of the bib is plastic, whereas in FIG. 3, the rear face of the bib is paper.

In an embodiment, the plastic layer 22 is a biodegradable plastic film. Exemplary biodegradable plastics include thermoplastic starch biodegradable plastic (TPS), starch synthetic Aliphatic Polyester Blend, Starch and polybutylene succinate (PBS) or polybutylene succinate adipate (PBSA) polyester blends: polylactic acid, etc.

Figure 9:
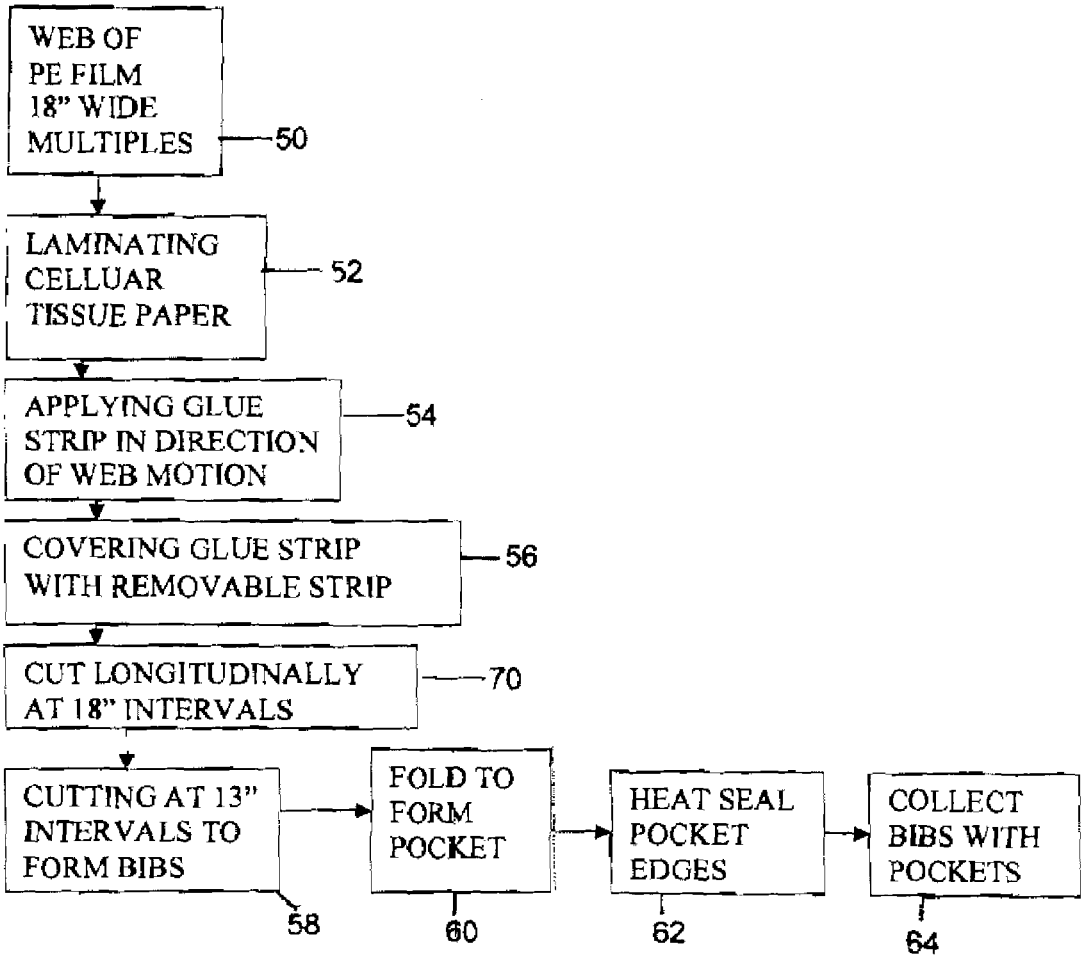
FIG. 9 shows a block diagram of the method of making the novel bib of FIGS. 1 and 3.

The method for making the novel bib is shown in FIG. 9 and comprises laminating a layer of plastic, most preferably, a polyethylene film, block 50, with at least two absorbent tissue paper layers, block 52, most preferably, a cellular tissue paper, which can include a previously printed decoration or motif. Although the paper layer may not be embossed, it is preferred that they are. The resulting lamination or bib blank occurs by an embossing technique, using a heated embossing roll, carried out so that an array of spaced depressions is made in the tissue layers while heating the polyethylene layer to cause impregnation of the tissue layers, at least where the embossing takes place. The array of embossed tissue depression portions of the tissue layers are pressed into the heated plastic layer, and the layers adhere together. The portions of the tissue layers surrounding the pressed tissue portions, i.e. the unpressed portions, are left substantially unaffected, and therefore, they retain their original characteristics for absorption of liquids and other foods. The lamination is next followed by a step of applying, preferably by continuously spraying, a biocompatible adhesive or glue across the top edge, or adjacent the top edge, block 54, of the exposed polyethylene layer on the rear side of the bib blank from one side edge to the opposite side edge, i.e. in a transverse direction relative to top to bottom of the bib. If the bibs are being made using traveling webs, then, in the direction of travel of the web. The adhesive chosen is one that will adhere to clothes or human skin and yet be easily removed with slight pulling with no adverse effects to the clothes or the skin. Such adhesives are well known in the art. Next, the adhesive stripe applied to the web is covered with a removable sealing tape or release paper, block 56, a strip of suitable material so that the adhesive is not exposed and is fully covered and yet the covering release paper is easily removable. Such materials are well known for several applications, such as, self-sealing envelops or Telfa™ bandages. Finally, the laminated structure is folded from the bottom to form a pocket on the back side of the bib blank, see block 60, with the plastic side edges of the pocket now brought together face to face and they are heat sealed, block 62. If the laminated structure is a moving laminated web, it is cut transversely at space intervals, block 58, and the resulting cut pieces (now bibs) are stacked. The webs are 18 inches wide (if wider, they are cut at 18 inch intervals transversely, block 70), and cut at 13 inch intervals longitudinally to produce bibs that are 13 inches wide and 18 inches long with the adhesive at the top edge of the inside rear face or side of the bib. As the bib is composed of a double layer of tissue laminated to single plastic layer, preferably polyethylene, the adhesive is on the polyethylene film side, the rear side of the bib. The pocket is formed on the inside rear face or side of the bib, also, on the polyethylene film side.

In another embodiment, the laminating a layer of plastic is a biodegradable plastic film. Exemplary biodegradable plastics include thermoplastic starch biodegradable plastic (TPS), starch synthetic Aliphatic Polyester Blend, Starch and polybutylene succinate (PBS) or polybutylene succinate adipate (PBSA) polyester blends, polylactic acid, etc.

As an alternative to the above, a novel bib is made by laminating a layer of plastic, most preferably, a polyethylene, sandwiched in between at least two absorbent tissue paper layers, most preferably, a cellular tissue paper (sandwich construction). Thus, one paper layer will lie on the front side of the bib and the other paper layer will lie on the rear side of the bib with the plastic layer sandwiched between them. The layer on the front side of the bib can be previously printed with a printed decoration or motif. A stripe of adhesive is placed (sprayed) on the rear side of the bib, from side to side, at or adjacent the top edge and covered with a release paper strip. The paper layer on the rear side of the bib extends from the top edge of the bib blank, but terminates spaced from the bottom edge of the bib blank by 2 to 8 inches. Therefore, the bottom portion of the bib blank has plastic exposed. The bottom portion of the bib blank is folded up to form a pocket 1 to 4 inches in depth on the rear side or face of the bib. Therefore, the exposed plastic layer is folded on itself and the side edges of the pocket are heat sealed together. The pocket formed has plastic, polyethylene, on the inside and paper on the outside with the edges of the folded up portion of the bib heat sealed along each of the folded up side edges to form a pocket in the bottom of the bib on the rear side that will be against the wearer. In use, the pocket is folded inside out, and comes to the front of the bib with the plastic now on the outside and paper on the inside. But more important, the pocket now is in a permanently opened condition, see FIG. 4, and will catch any food and drippings that falls down on or adjacent to the bib while being worn by a user. With paper now on the inside of the pocket, there will be better absorption of food and drippings. When the wearer is finished eating, the bib can be removed and used as a napkin because paper is on both sides of the bib.

In another embodiment, the laminating a layer of plastic is a biodegradable plastic film. Exemplary biodegradable plastics include thermoplastic starch biodegradable plastic (TPS), starch synthetic Aliphatic Polyester Blend, Starch and polybutylene succinate (PBS) or polybutylene succinate adipate (PBSA) polyester blends, polylactic acid, etc.

The folded up portion can be from 1 to 4 inches deep to form a suitable pocket to catch the spills or droppings. If traveling webs are being used, the folding up of the lower portions of the bib blanks can take place before the bib blanks are cut transversely at longitudinally spaced intervals with the cutting and the heat sealing of the folded up edges occurring simultaneously. However, the folding up to form the pockets and the heat sealing of the edges of the pockets can take place either before or after the cutting into individual bib blanks.

A further improvement consists of using a laminated web that is a multiple width of the length of the bib to be made, i.e. 2×, 3×, . . . n×, and the adhesive sprayed onto or adjacent one edge of the polyethylene web, at the appropriate transversely space locations, as the web travels or moves longitudinally. Thereafter, the adhesive stripes can be covered with a release tape; the webs, if more than 18 inches wide are cut longitudinally at 18 inch intervals to divide the web into bib length sections, and then, the web can be cut at predetermined transverse intervals, such as 13 inches to create blanks that are bib wide. Thereafter, the cut web blanks are finished by folding to form pockets as described in the foregoing, heat sealed to perfect the pockets and folded and/or stacked.

Although the bibs have been shown and described as rectangular, the bibs can be of any geometry. Also, the top edge of the bibs can be straight, as shown, or curved in any manner, such as, to form a round neck or scoop neck, to fit a wearer more comfortably.

Although the invention has been described and shown in terms of preferred embodiments, nevertheless changes and modifications will occur to those of skill in the art from knowledge of the teachings herein. Such changes and modifications are deemed to fall within the purview of the invention as expressed in the claims hereto.

What is claimed is:

1. A bib having a front side and a rear side, a top and a bottom and opposite side edges composed of a layer of plastic and two layers of absorbent paper laminated together, one of said two layers of absorbent paper lying on the rear side of the plastic layer and the other of said two layers of absorbent paper lying on the front side of the plastic layer, an adhesive coated on the rear side of the bib adjacent its top and extending between the opposite side edges, a release tape covering the adhesive, and a pocket extending between the opposite side edges formed at the bottom of the bib on its rear side having plastic on the inside of the pocket and paper on the outside of the pocket, so that when the pocket is turned inside out, it comes to the front side of the bib and maintains an opened condition, and wherein the paper layer lying on the rear side of the bib terminates spaced from the bottom of the bib to accommodate the pocket.

2. A bib according to claim 1 wherein the two layers of absorbent paper are embossed together.

3. A bib according to claim 2 wherein the two layers of absorbent paper have an array of spaced depressions heat sealed to the plastic film.

4. A bib according to claim 3 wherein the depressions are rectangular.

5. A bib according to claim 1 wherein the pocket is 1 to 4 inches deep.

6. A method of making a bib comprising the steps of laminating a plastic layer at preselected geometry with two layers of absorbent paper with similar preselected geometry to form a laminated construction having a front side and a rear side, a top and a bottom and opposite side edges, with one of said two layers of absorbent paper lying on the front side of the plastic layer and the other of said two layers of absorbent paper lying on the rear side of said plastic layer and terminating spaced from the bottom to expose the plastic layer and to allow formation of a pocket;

applying a stripe of an adhesive adjacent the top of the rear side of the lamination;

covering the stripe of adhesive with a release tape;

forming a pocket on the rear side of the lamination at the bottom, from the exposed plastic layer, having plastic on the inside of the pocket and paper on the outside of the pocket, so that when the pocket is turned inside out, it comes to the front side of the lamination and maintains an opened condition.

7. The method of claim 6 wherein the absorbent paper is a tissue paper.

8. The method of claim 6 wherein the plastic layer is polyethylene.

9. The method of claim 6 wherein the paper layers are embossed to form an array of spaced areas of a predetermined configuration.

10. The method of claim 6 wherein the preselected geometry is rectangular.

11. The method of claim 6 wherein the plastic layer and paper layers are initially in the form of webs that are laminated together with a longitudinal portion on the rear side of the laminated web being exposed plastic layer to allow formation of a pocket.

12. The method of claim 11 wherein the laminated web is a predetermined dimension wide.

13. The method of claim 11 wherein the laminated web has a width a multiple of a predetermined bib length, and includes the further steps of cutting the laminated web into longitudinal sections each a width equal to bib length, and applying the stripe of adhesive adjacent one edge of each section, the opposite edge of each section being exposed plastic layer to allow forming of a pocket.

14. The method of claim 11 including the further steps of folding the edge of the laminated web with exposed plastic layer, opposite the edge to which the adhesive is applied, and heat sealing the edges of the folded laminated web to form pockets on the same side of the web as the adhesive.

15. The method of claim 11 wherein bib blanks are individuated from the laminated web, and pockets are formed by folding up the exposed plastic layer edge of the bib blank opposite the edge adjacent to which adhesive has been applied, and heat sealing the folded up side edges of the bib blanks.

16. The method of claim 6 wherein the absorbent paper is 19 gram tissue paper and the plastic is polyethylene.

17. The method of claim 6 including imprinting the absorbent paper with a design or motif.

* * * * *